US005572939A

United States Patent [19]

Beatty

[11] Patent Number: 5,572,939

[45] Date of Patent: Nov. 12, 1996

[54] TUFTING MACHINE DRIVE ASSEMBLY

[75] Inventor: Paul E. Beatty, Chattanooga, Tenn.

[73] Assignee: Card-Monroe Corp., Chattanooga, Tenn.

[21] Appl. No.: 426,804

[22] Filed: Apr. 21, 1995

[51] Int. Cl.[6] ..... D05C 15/20; F16C 3/04

[52] U.S. Cl. ..... 112/80.4; 112/221; 74/591; 74/603

[58] Field of Search ..... 112/80.01, 80.4, 112/220, 221; 74/603, 604, 44, 591; 123/192.1, 192.2

[56] References Cited

U.S. PATENT DOCUMENTS

| | | | |
|---|---|---|---|
| 2,128,120 | 8/1938 | Christensen et al. | 112/197 |
| 3,361,096 | 1/1968 | Watkins . | |
| 3,460,498 | 8/1969 | Eguchi et al. | 112/221 |
| 3,563,222 | 2/1971 | Ishida | 123/192 |
| 4,120,254 | 10/1978 | Herr et al. . | |
| 4,419,944 | 12/1983 | Passons et al. . | |
| 4,485,752 | 12/1984 | Slomma et al. | 112/221 |
| 4,501,212 | 2/1985 | Slattery . | |
| 4,515,096 | 5/1985 | Ingram . | |
| 4,539,922 | 9/1985 | Klundt | 112/221 |
| 4,586,445 | 5/1986 | Card et al. . | |
| 4,628,876 | 12/1986 | Fujikawa et al. . | |
| 4,632,072 | 12/1986 | Brogdon . | |
| 4,665,845 | 5/1987 | Card et al. | 112/80.4 |
| 4,669,403 | 6/1987 | Bagnall | 112/80.4 |
| 4,741,303 | 5/1988 | Kronich . | |
| 4,754,718 | 7/1988 | Watkins | 112/80.52 |
| 4,936,268 | 6/1990 | Randle . | |
| 4,966,042 | 10/1990 | Brown | 74/44 |
| 5,038,727 | 8/1991 | Burns et al. . | |
| 5,282,397 | 2/1994 | Harkness et al. | 74/44 |
| 5,287,819 | 2/1994 | Beatty et al. | 112/80.01 |

FOREIGN PATENT DOCUMENTS

| | | |
|---|---|---|
| 59-94664 | 5/1984 | Japan . |
| 2181163 | 4/1987 | United Kingdom . |

*Primary Examiner*—Paul C. Lewis
*Attorney, Agent, or Firm*—Hopkins & Thomas

[57] ABSTRACT

A drive assembly for reciprocating connecting links includes a single, main drive shaft and alternating, counterrotating and direct individual drive assemblies. The drive assembly is particularly adapted for use in devices such as carpet tufting machines which require high speed reciprocation of connecting links and push rods. The drive assembly is designed to counterbalance undesirable multidirectional reciprocating forces generated by the drive assembly itself and other machine elements. The drive assembly, therefore, operates at high speeds while reducing overall machine vibration.

21 Claims, 5 Drawing Sheets

TUFTING MACHINE DRIVE ASSEMBLY

FIELD OF THE INVENTION

This invention generally relates to machines having drive mechanisms which drive or reciprocate a rod or connecting link. This invention is particularly suitable for use in tufting machines to drive push rods which reciprocate, for example, the tufting machine needle bar.

BACKGROUND OF THE INVENTION

Many types of automated machinery require drive mechanisms to reciprocate machine elements within a defined range of motion. One specific example of such drive mechanisms are those used in tufting machines to reciprocate the needle bar. Advances in the production capacity of tufting machines generally has followed improvements in the needle bar drive mechanisms. The speed at which these drive mechanisms rotate generally dictates the speed of reciprocation of the needle bar, which primarily determines production capacity. Therefore, increasing the speed of the needle bar drive mechanism has been the primary focus of attempts to improve the operation of tufting machines.

For example, U.S. Pat. No. 4,665,845 to Card et al. discloses a tufting machine needle drive mechanism which includes individual needle drive assemblies driven by the main drive shaft. These individual drive assemblies are spaced along the main shaft, and are driven in the same direction as the main shaft by timing belts. This arrangement greatly improved the production capacity of the tufting machines then in use, by increasing the revolutions per minute of the drive mechanism from about 750 to 1,000 rpm to over 1,300 rpm. The rotational speed at which this type of drive mechanism could operate, however, was limited to some extent by the multidirectional vibrational forces caused by the many reciprocating elements of the machine, such as the loopers and knives.

An improvement to such drive mechanisms is disclosed in U.S. Pat. No. 5,287,819 to Beatty et al. This drive mechanism includes separate needle drive assemblies, but also includes additional mechanisms which offset many of the vibrational forces caused by the reciprocating machine elements. Specifically, the drive mechanism disclosed in this patent includes two main drive shafts, one driven in counterrotational movement by the other, with the individual needle drive assemblies also being driven in opposite directions by their respective drive shaft. This counterrotational movement, together with the placement of counterweights along the main drive shaft, greatly reduces the overall vibration in the tufting machine during operation. This configuration and its associated reduction in vibration, make it possible for this machine to operate of speeds in excess of 2,000 rpm, greatly increasing machine performance and production capacity.

While this machine represents a significant improvement over the drive mechanisms of the prior art, its design requires a second drive shaft and associated support and journaling elements. The design also requires reversing drives at each end for imparting counterrotational movement to the second drive shaft. Additionally, the design, while safe, efficient and reliable, necessitates the need to accurately time the rotation of the respective drive shafts in order to control the timing of the elements driven therefrom.

SUMMARY OF THE INVENTION

The present invention comprises a drive mechanism for reciprocating driven machine elements, which is capable of operating of speeds in excess of 2,000 rpm, and which includes improved machine balancing mechanisms. While the present invention is disclosed herein for use in driving a reciprocating needle bar of a tufting machine, the invention can be used in many other applications which require the driving of an element in a reciprocating movement. The different design of the present invention over known tufting machine drive mechanisms results in these advantages, while eliminating the need for numerous elements found in many known high speed drive mechanisms.

The invention includes a single, main drive shaft driven in any conventional manner in one direction of rotation. Individual needle stroke drive assemblies are arranged at spaced locations along the main drive shaft, and each are driven by the main drive shaft. The drive assemblies are specifically configured so that every other drive assembly rotates in the opposite direction from its next adjacent drive assembly. This is accomplished by the arrangement of timing or drive belts driven from the main shaft. This counterrotation results in the counteracting of many of the horizontal forces created by other elements of the tufting machine such as the loopers and knives. Each individual needle drive assembly also includes counterweights positioned between supporting stub shaft bearings, which counteract the vertical forces created by the movement of the connecting rods, push rods, and needle bar.

The particular arrangement of the present drive mechanism results in a highly efficient drive comprised of a minimum of moving parts, resulting in longer life and less wear than any known device capable of operating at similar speeds and low levels of vibration. The elimination of reversing drive mechanisms also results in more easily controlled and precise machine timing.

It is an object of the present invention, therefore, to provide a drive mechanism for a reciprocating device, such as a tufting machine, which results in improved counterbalancing of the multidirectional machine forces, while driving its associated elements at high speeds. It is another object of the present invention to provide a tufting machine drive mechanism which accomplishes the above stated advantages using a simpler and more efficient design than those of known such devices which are capable of operating at relatively high speeds. Other objects, features, and advantages of the present invention will become apparent upon reading the following specification in conjunction with the accompanying drawing figures.

DETAILED DESCRIPTION OF THE PREFERRED EMBODIMENTS

Figure 1:
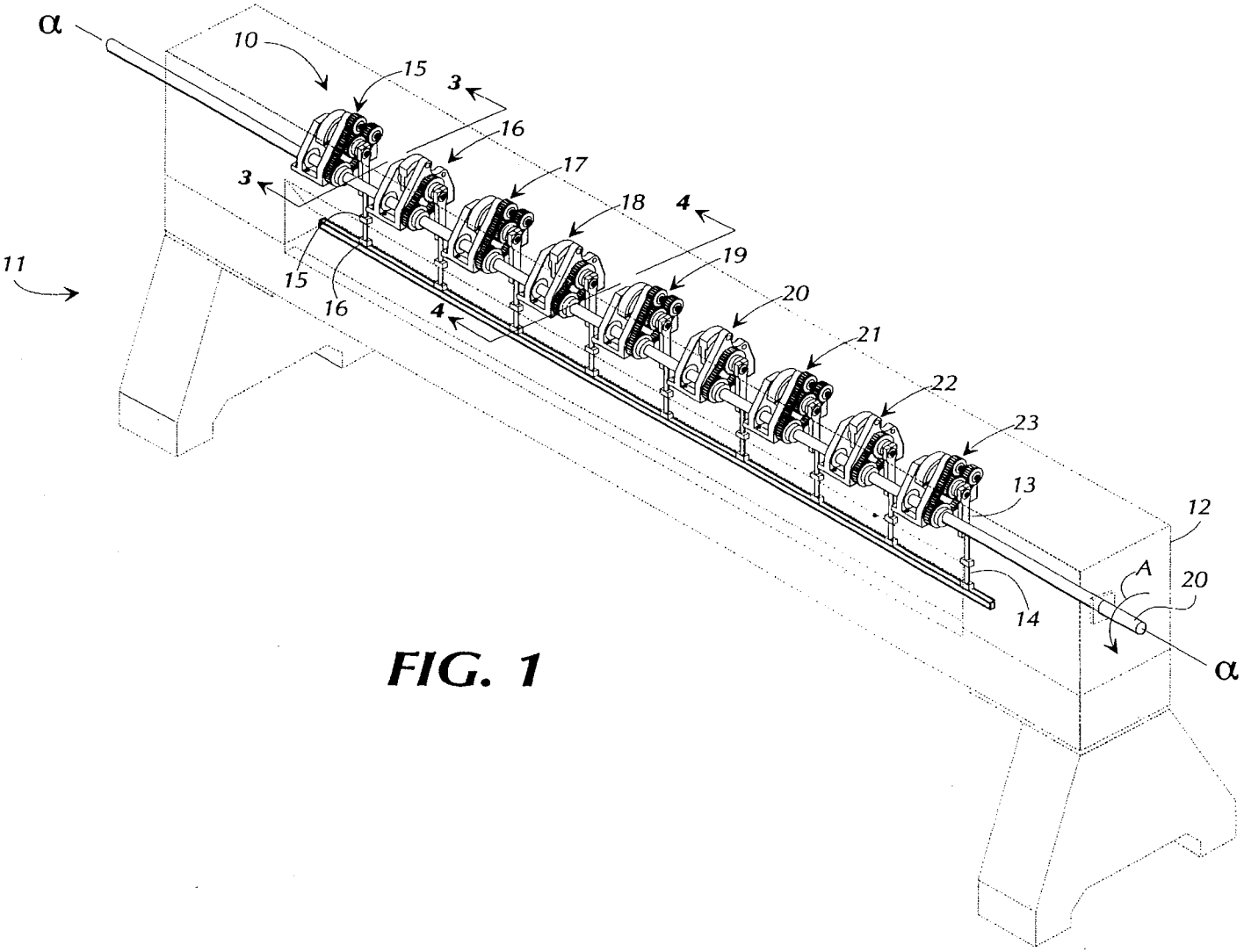
FIG. 1 is a perspective view of a carpet tufting machine incorporating the drive mechanism of the present invention.

FIG. 1 shows an example of a drive assembly 10 of the present invention. For the purposes of illustration, the drive assembly 10 is shown configured for use in driving the needle bar of a carpet tufting machine. More specifically, the drive assembly 10 shown in FIG. 1 is configured for use in a four meter sewing width tufting machine 11. As will be further explained herein, the drive assembly 10 of the present invention is not limited to this tufting machine application, but can be used with other types of machines which require balanced, high speed driving of reciprocated elements. Tufting machine 11 includes head 12 which supports and encloses the drive assembly for safety and for lubrication of the elements.

This drive assembly can be mounted in and drive the connecting rods, push rods, and needle bar of most conventional tufting machines. Therefore, for the purposes of the present invention, the elements of the tufting machine 11 other than the novel configuration of the drive assembly 10, are commonly known to those skilled in the art. Principal elements of these tufting machines, other than the drive assembly, which relate to the present invention are identical to those disclosed in U.S. Pat. No. 5,287,819, which is commonly owned, and which patent is incorporated herein by reference. The drive assembly 10 of the present invention is intended to reciprocate connecting rods 13 which are connected to push rods 14 that extend downwardly through the tufting machine head 12 and are slidably retained by journal members 9. Push rods 14 are, in turn, connected by support blocks to needle bar 7, so that the operation of drive assembly 10 reciprocates the connecting rods, push rods and needle bar in the same general range of motion as that of known drive assemblies.

The structure and operation of drive assembly 10, however, represent an improvement over known drive assemblies, including in its ability to operate at high speeds while countering or offsetting machine forces, which achieves low, overall vibrational effects. The drive assembly 10 of the present invention is comprised of at least two individual needle stroke drive assemblies such as assemblies 15 and 16. These needle stroke drive assemblies accomplish the same operational effect, that is reciprocation of a connecting link, but themselves are constructed differently and counterrotate with respect to one another. For the purposes of the four meter tufting machine shown in FIG. 1, drive assembly 10 is comprised of nine separate needle stroke drive assemblies equally spaced along the head 12 of the tufting machine. These individual, needle stroke drive assemblies correspond to reference numerals 15–23, with the odd numbered assemblies 15, 17, 19, 21, and 23 being identical to one another. Conversely, the even numbered drive assemblies, 16, 18, 20, and 22 are identical to one another. A greater or lesser number of drive assemblies can be used depending upon the application. In the example of a carpet tufting machine, the width of the tufting machine and therefore the length of the needle bar can dictate the number of needle stroke drive assemblies used. It is important, however, for the counteraction of the centrifugal forces caused by the drive assemblies themselves, that the drive assembly 10 include at least two, counterrotating, individual needle stroke drive assemblies, such as assemblies 15 and 16.

The drive assembly 10 includes a single, main drive shaft 20 which extends along axis $\alpha$ substantially the entire carpet sewing width of the tufting machine. A motor (not shown) is mechanically coupled to main shaft 20 to drive main shaft 20 counterclockwise as shown in FIG. 1 in the direction of arrow A. Importantly, this drive assembly 10 accomplishes the necessary counteracting of many reciprocating and centrifugal forces, and then achieves high speeds of operation, with only one main drive shaft 20. For the purposes of the present invention, it is considered that a main drive shaft constitutes a shaft that extends substantially the entire tufting machine carpet sewing width, as opposed to shorter drive shafts such as the segmented or stub drive shafts hereinafter disclosed.

Figure 2:
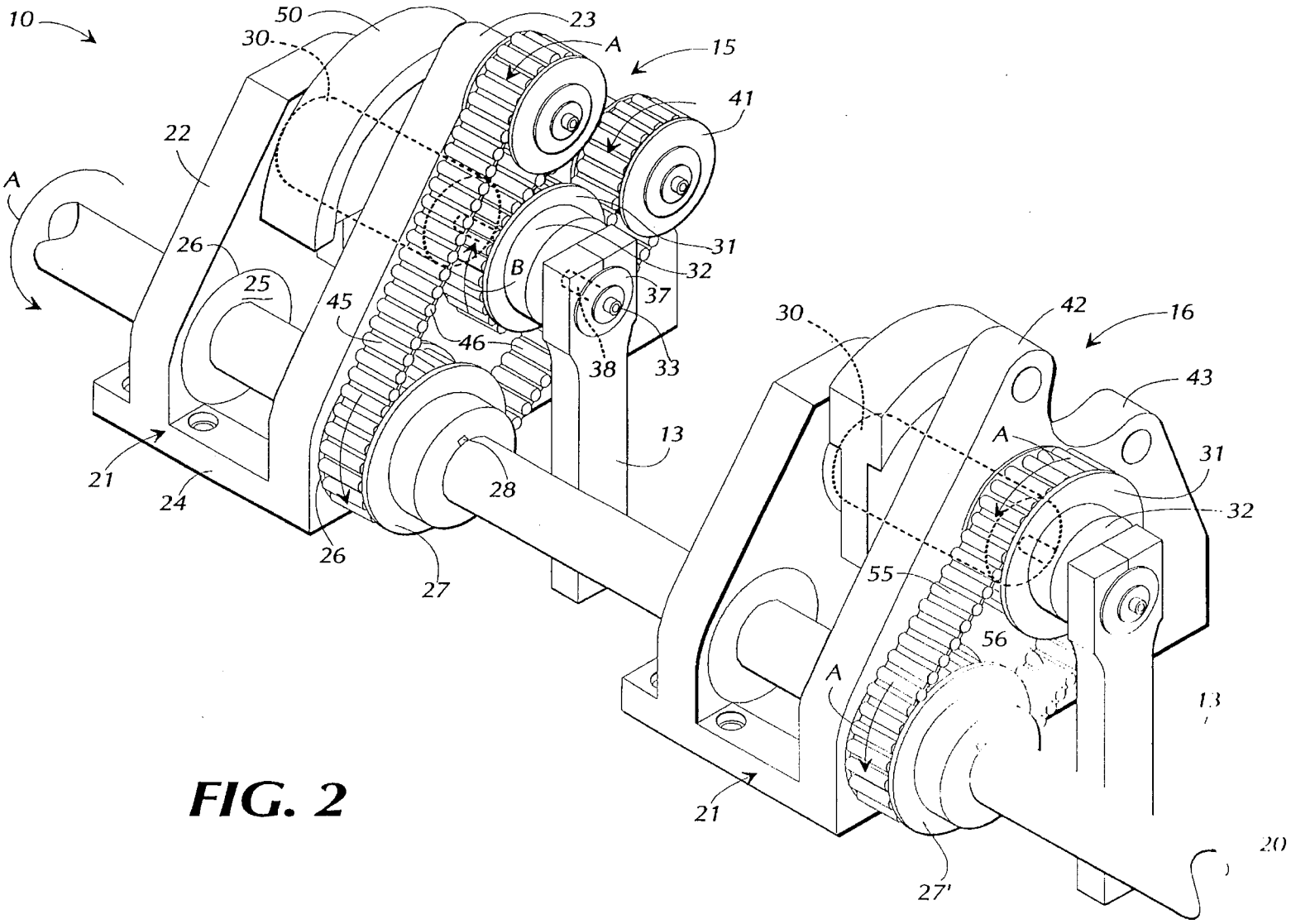
FIG. 2 is a perspective view of two counterrotating needle stroke drive assemblies of FIG. 1.
Figure 4:
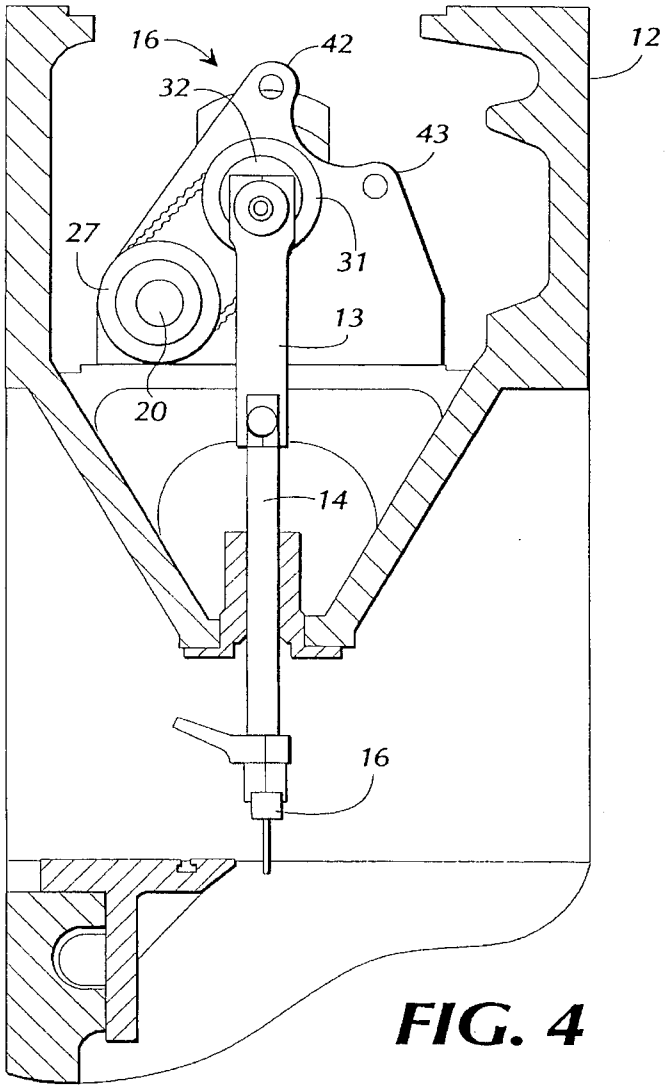
FIG. 4 is a vertical sectional view of the upper portion of the tufting machine of FIG. 1 taken along sectional lines 4—4, and showing a positive needle stroke drive assembly.
Figure 3:
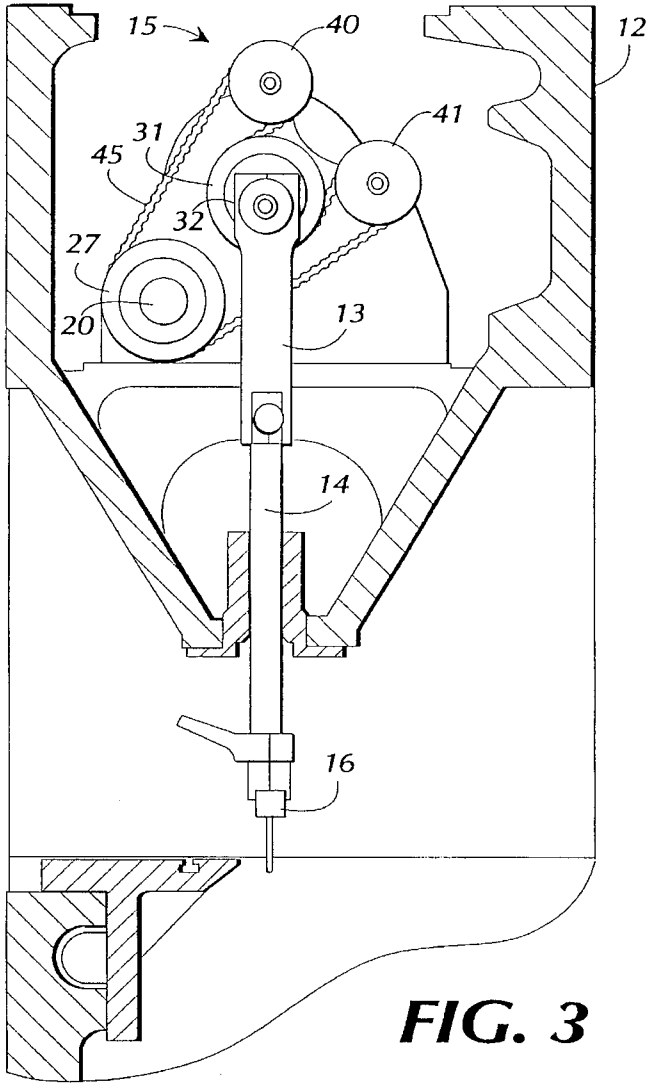
FIG. 3 is a vertical sectional view of the upper portion of the tufting machine of FIG. 1. taken along sectional lines 3—3, and showing a counterrotating needle stroke drive assembly.

A complete drive assembly consists of a single, main drive shaft and at least two counterrotating, individual stroke drive assemblies as shown in FIG. 2. As discussed, the drive assembly 10 of the present invention must include at least two counterrotating needle stroke drives, such as drives 15 and 16, in order to constitute a complete drive assembly. Any number of additional, individual needle stroke drive assemblies can be added, as required by the application. Individual needle stroke drive assembly, or push rod station, is considered a counterrotating drive assembly, since the needle drive timing sheave of assembly 15 is driven in a counterrotating direction from the direction of arrow A of main drive shaft 20. Needle stroke drive assembly 15 is comprised of pillow block 21 which is fastened by any suitable fastener such as bolts to a supporting base plate (not shown) in the head 12 of the tufting machine in standard fashion. Pillow block 21 includes flanges 22 and 23 which are integrally cast or molded to base 24. Flanges 22 and 23 are spaced, upstanding substantially triangular, planar support members comprised of cast steel or other suitable material capable of supporting its associated elements. Each flange 22 and 23 defines along one side, axially aligned openings 26 through which main drive shaft 20 passes. Bearings 25 are positioned in openings 26 to support and permit rotation of shaft 20.

A main shaft timing sheave 27 is secured by a key or detent 28 to main shaft 20 in order to turn therewith. Towards the apex of flanges 22 and 23 are defined additional aligned openings (not shown) which receive a stub shaft or spindle 30 shown in phantom lines. The stub shaft is carried by and journaled within pillow block 21 by suitable bearings well known in the art, such as those disclosed in U.S. Pat. No. 5,287,819, and extends longitudinally parallel to main shaft 20. The stub shaft 30 defines longitudinally therethrough an open channel (not shown). Stub shaft 30 protrudes from flange 23 in cantilever fashion so as to provide a mounting surface on stub shaft 30 for needle drive timing sheave 31. The needle drive timing sheave defines a central opening, and can be press fit or otherwise suitably fastened to stub shaft 30 in order to rotate therewith. Attached to the needle drive timing sheave is stroke cam 32. The stroke cam 32 also defines a central hole therethrough, and is assembled to the needle drive timing sheave so that their respective central holes are aligned. A draw bolt (not shown) passes through the respective, aligned openings in stroke cam 32, needle drive timing sheave 31 and stub shaft 30. On the opposite end of the draw bolt is a nut or other fastening means that is tightened to secure the stroke cam to the needle drive timing sheave. An eccentric pinion 35 extends outwardly from the outer surface of stroke cam 32, and defines an internally threaded, axial bore. A bearing (not shown) is received on the outer surface of eccentric pinion 35.

Connecting link 13 is received over pinion 35 and its associated bearing so as to rotate freely about pinion 35. A securing pin or threaded bolt 33 extends into the axial bore of pinion 35, and along with washer 37, secure connecting link 13 to pinion 35. The cooperation of the above elements, and their structure are well known in the art and substantially described in the two above-referenced U.S. patents.

It is evident, therefore, that the rotation of stroke cam 32 causes connecting link 13 to reciprocate back and forth in an eccentric, orbital path. Two idlers, or reversing pulleys, 40 and 41, are supported by flange 23 to be spaced from needle drive timing sheave 31 as shown in FIG. 2. Idlers 40 and 41 are journaled by any suitable means to flange 23 at positions 42 and 43 respectively, as best seen on pillow block 21 of needle stroke drive assembly 16 (FIG. 2). A double sided drive belt 45, which has teeth 46 along both sides, is positioned around main shaft timing sheave 27, idlers 40 and 41, and needle drive timing sheave 31. The wrapping of belt 45 around idlers 40 and 41 and around sheave 32 as shown in FIG. 2 dictates that as main shaft 20 is rotated in the direction of arrows A, pulleys 27, 40 and 41 will likewise be rotated in this direction of the main drive shaft 20, while needle drive timing sheave 31 and its associated stroke cam 32 are rotated in the opposite or counterrotating direction, shown by arrow B.

The spacing of flanges 22 and 23 of the pillow block permit a counterweight 50 to be securely fastened to the portion of stub shaft 30 passing between flanges 22 and 23. As stub shaft 30 is rotated in the direction of arrow B along with stroke cam 32, counterweight 50 also will rotate in that direction within the space between flanges 22 and 23 and the associated bearings (not shown) which journal stub shaft 30 on pillow block 21.

A second, individual needle stroke drive assembly 16 is spaced from drive assembly 15 along main shaft 20. Drive assembly 16 is comprised of elements which are substantially identical to many of those elements described above of drive assembly 15, and therefore are shown in FIG. 2 with the same reference numerals. Needle stroke drive assembly 16, however, does not include idlers 40 and 41. The protruding portions 42 and 43 of pillow block 21 of drive assembly 16, therefore, are not used to support any idlers. Since idlers 40 and 41 are not utilized in drive assembly 16, therefore, belt 55 which passes around main shaft timing sheave 27 and needle drive timing sheave 31 of assembly 16 includes teeth 56 along its inner side only. Drive assembly 16 is considered a positive or direct drive assembly as opposed to a counterrotating drive assembly, such as assembly 15, in that the needle drive timing sheave and stroke cam of assembly 16 are rotated in the same direction as the main shaft 20, shown by arrows A. Therefore, the stroke cams of assemblies 15 and 16, as well as their respective connecting links, rotate in opposite directions. The stroke cams of each drive assembly, however, are rotated in timed relationship so as simultaneously to be in the top dead center position and the bottom dead center position.

The counterweights 50 are mounted onto the stub shafts so that the offset or eccentric mass of the counterweights are timed in phase to reach the top dead center position when the pinions and their respective connecting links reach their bottom dead center positions. The counterweights, therefore, oppose the vertical forces of the connecting link, the push rod, and the needle bar, since the counterweights are rotating upwardly as the connecting link and needle bar are pushed downwardly. The positioning of the counterweights between the spaced bearings (not shown) which journal stub shafts 30 on pillow blocks 21, redistributes the push rod and needle bar forces more evenly from the front bearing nearest the push rod to the rear bearing. This positioning, together with the rotational timing of the counterweights which counteracts much of these vertical needle bar forces, relieves these bearings from absorbing those forces, resulting in less bearing wear and longer bearing life. The use of a counterweight for every push rod station also results in overall or global needle bar force countering, rather than simply countering the forces at each individual needle drive assembly or push rod station.

The counterweights serve the dual purpose of offsetting centrifugal and inertial forces, and also act as flywheels to help lower the average torque required through a machine cycle. The design of the size, shape, and material of the counterweights is within the knowledge of those skilled in the art. Additionally, commercial solid modeling computer programs such as Pro-Engineer sold by Parametric Technology Corporation can be used to assist in calculating the mass moment inertia, center of gravity and mass of the counterweights.

More specifically, the counterweights are designed to offset the inertial forces resulting from the reciprocating needle bar, guides and their support structures, and the centrifugal forces resulting from the orbiting pinion and connecting rod used in generating the reciprocating motion of the needle bar. Those skilled in the art know that the inertial forces of the needle bar are a function of needle bar stroke, needle bar mass and the rate of reciprocation or machine speed. The needle bar stroke and mass are governed by the type of carpet to be produced. For certain styles such as residential cut pile carpet, a longitudinally sliding needle bar may be required. This requirement increases the mass of the needle bar support structure and also requires a greater needle bar stroke to allow time for the needle bar to move longitudinally while the needles are above the carpet backing material. Therefore the machine required to manufacture this style carpet generates high inertial and centrifugal forces in the needle drive mechanism at a given speed. In contrast, a loop pile machine with a low pile height and no requirement of a sliding needle bar, requires a needle bar stroke approximately one-half that of the previously mentioned style. It also has a reduced mass in the needle bar support structure. This greatly reduces the forces generated by the needle bar and its supports and drive mechanism at a given speed.

The centrifugal force of a counterweight is a function of the speed of rotation of the mass, the mass of the counterweight, and the distance between the center of mass of the counterweight and its rotational axis. Since the rotational speed of the counterweight and the reciprocating speed of the needle bar are the same, the speeds cancel out and leave the product of the mass and distance to the center of mass. The total mass of the needle bar and its supports and drive components is divided by the number of needle drive stations. This determines the force that one counterweight must offset. From that the product of the mass of the counterweight and the distance to the center of gravity may be determined. Different shapes and sizes of counterweight are then analyzed mathematically and by using computer solid modeling to determine its center of gravity and mass.

The counterweights also accomplish a flywheel effect. The torque to drive the needle bar is proportional to the mass, the stroke squared, and the speed squared. The torque peaks four times during one machine revolution. These peaks occur as the needle bar is: accelerated from the top of its stroke toward the bottom of stroke; decelerated as it approaches the bottom of its stroke; accelerated from the bottom of stroke toward the top of stroke; and decelerated as it approaches the top of its stroke. Therefore there are two positive peaks and two negative peaks. This causes the machine speed to fluctuate through one complete machine revolution. This is detrimental to drive components such as belts and gears.

A flywheel acts basically as an energy storage device. In this case the energy is kinetic rotational energy. As a flywheel is decelerated it gives off energy in the form of torque. The amount of torque is governed by the mass moment of inertia of the flywheel and the amount of acceleration or deceleration. The mass moment of inertia depends on the size, shape and density of the flywheel. As the needle drive approaches a point in its revolution of peak positive torque, the machine starts to decelerate. As the flywheels are decelerated, they add torque to the system. This basically lowers the peak torque requirements of the drive. There are periods in the machine revolution where the torque is essentially zero. During these periods the energy is returned to the flywheels by accelerating them. This process serves to smooth the revolution of the machine and lowers the amount of speed fluctuation as the machine operates.

There is a point, however, where the moment of inertia is so great, that the time and torque required to stop the machine becomes unacceptable. Therefore, the design of the counterweight/flywheel is a trade-off between the degree in which one wants to lower the peak operating torque verses the torque and time one deems as acceptable to stop the machine. The larger counterweights are used on the reversing locations to lower the operating torque requirement for the double-sided belts that drive the needle drive mechanism. This is due to the lower rating of a double-sided gear belt in contrast to a single sided belt. The same counterweight could be used on both types of drives, however, the total machine inertia would be greater than what we currently desire.

Figure 6:
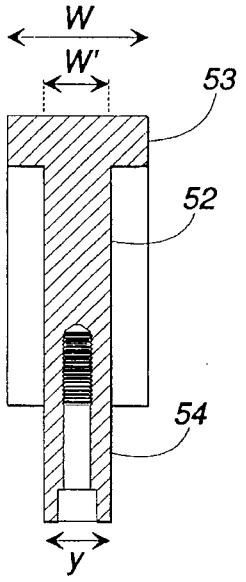
FIG. 6 is a vertical, sectional view of the counterweight of FIG. 5.
Figure 5:
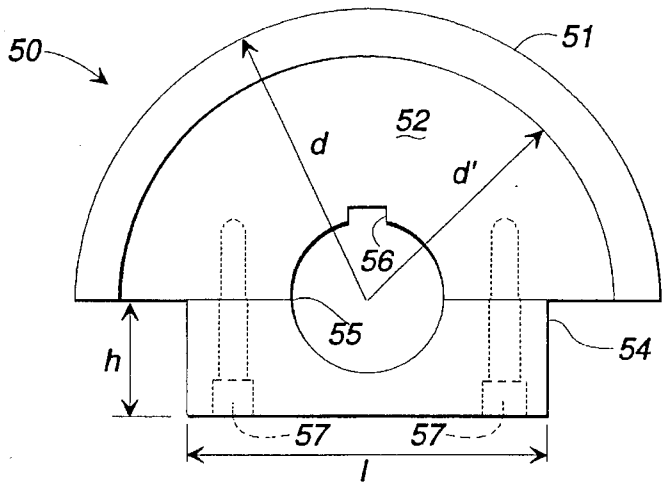
FIG. 5 is an elevational view of an example of a counterweight used on a counterrotating needle stroke drive assembly of the present invention.

FIGS. 5 and 6 insert one embodiment of the counterrotating counterweight or flywheel 50 used in association with counterrotating drive assembly 15. Counterweight 50 includes an eccentric, semicircular plate portion 51 having substantially planar web 52 and an outwardly projecting circumferential rim 53. A rectangular retaining collar 54 is separate from counterweight 50 and along with counterweight 50 defines an aperture 55 with a keyed notch 56 so that counterweight 50 can be received around stub shaft 30. Pins 57 extend through bores defined through collar 54 and into bores defined in counterweight 50 to securely fasten collar 54 to counterweight 50. In the embodiment shown in FIG. 5, the counterweight is constructed along a radius that is equal to 4.25 inches from a central point to the outer edge of rim 53 and a distance d' from the center point to the lower edge of rim 53 equal to 3,563 inches. The width w of the rim 53 is two inches by the width w' of the web is one inch. The width y of collar 54 is one inch, if length 1 is 5.25 inches and its height h is 1.750 inches. The fastener 57 which is an externally threaded bolt is one and one-fourth inches in length and ⅜ inches in diameter.

Figure 8:
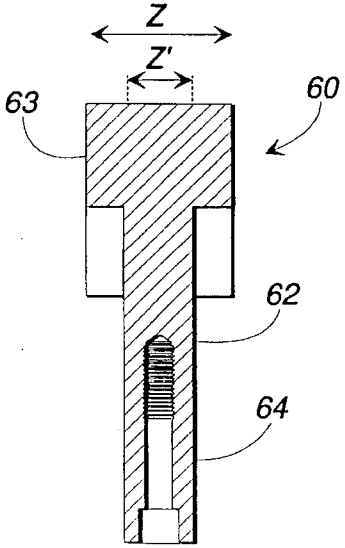
FIG. 8 is a vertical, sectional view of the counterweight of FIG. 7.
Figure 7:
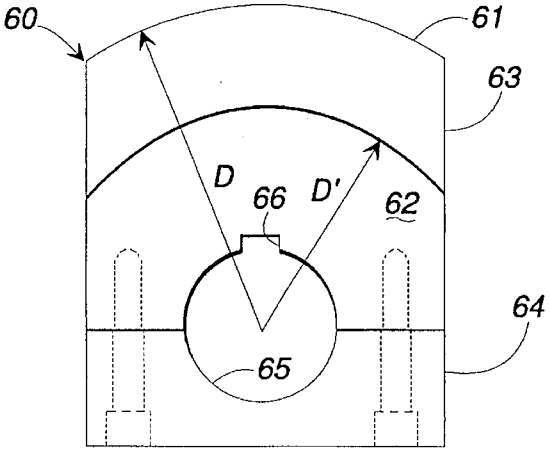
FIG. 7 is an elevational view of an example of a counterweight used on a positive needle stroke drive assembly of the present invention.

The counterweight 60 for the positive drive assembly 16 is shown in FIGS. 7 and 8. This counterweight 60 which is merely an example of a counterweight used in conjunction with the present invention is structured along an arc of a circle and includes an upper plate 61, a web 62, and a rim 63. A rectangular collar 64 is releasably attached to counterweight or flywheel 60 and defines along with counterweight 60 aperture 65 and keyway 66. Collar 64 also functions to hold counterweight 60 onto the stub shaft 30 of positive rotating drive assembly 16. The distance D of counterweight 60 from the central point to its circumferential edge is equal to 4.5 inches, while the distance d' from the central point to the inner edge of rim 53 is equal to 3.25 inches. The rim 63 includes a width z of 2 inches, while the web 62 includes a width d' of 1 inch. The collar 64 of counterweight 60 is identical in structure and shape to collar 54. Again, these are only examples of the counterweights used in the above-referenced machine chosen for illustration, and any other shape and size counterweight having the appropriate mass moment of inertia, mass and center of gravity calculated considering the above parameters will work satisfactorily.

While vertical forces are generated in tufting machines by the reciprocation of the needle bar, the push rods and the connecting links, horizontal forces also are generated in these machines by the reciprocation of the loopers and, in cut pile tufting machines, the knives, and their associated carriages. These forces are countered to a large extent by the use of the individual, spaced, sequentially counterrotating needle drive assemblies. Further balance is provided by ensuring that every other needle drive assembly is counterrotating its associated stroke cam with respect to the assemblies next adjacent, and that an odd number of individual needle drive assemblies is used. The result is a tufting machine drive assembly which not only operates at very high rotational speeds, but also which is designed to offset the undesirable reciprocating forces generated by the moving machine parts, thus greatly reducing overall machine vibration.

The elimination of the reversing mechanisms, such as those taught in U.S. Pat. No. 5,287,819, also reduces potential timing difficulties, since the individual needle drives or push rod stations are more easily placed in timed relationship. Additionally, the counterrotation of the needle drive mechanisms themselves counter each other so as to reduce any cumulative vibrational amplitude caused by the rotation of these mechanisms. The elimination of the second main shaft and the utilization of the sequential counterrotating drive mechanisms also spreads the total load to be driven among the individual drive assemblies, and thereby reduces the larger load that needed to be carried by the belts of the end unit reversing drives used in other high speed tufting machines.

FIG. 1 shows an example of the present invention used on a four meter carpet sewing width tufting machine, which utilizes nine separate, individual drive stations. As long as two or more counterrotating stations are used, the present invention will perform satisfactorily. In cases in which an even number of drive stations are used, it may be desirable to affix another counterweight to the central portion of the main drive shaft in order to more effectively counteract the principally horizontal forces caused by the reciprocation of the loopers and knives.

While the present invention preferably employs the use of timing belts in the individual needle drive assemblies, the needle bar timing sheaves could be directly driven from the main shaft using gears arranged to permit either counterrotation with respect to the main drive shaft or positive or direct rotation in the same direction as the main shaft.

Figure 9:
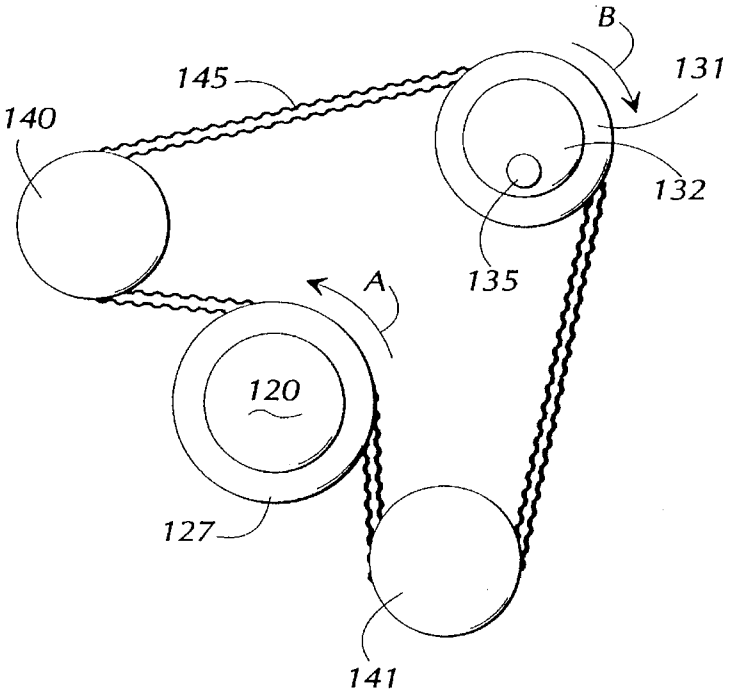
FIG. 9 is a schematic view of the sheave and belt arrangement of another embodiment of a counterrotating needle bar drive assembly of the present invention.

FIG. 9 schematically shows an alternative belt and pulley arrangement for a counterrotating needle stroke drive assembly of the present invention, with the main shaft 120 rotating in the direction of arrow A and the needle drive timing sheave 131 rotating in the counterrotational direction of arrow B.

In FIG. 9, the main shaft 120 supports main shaft pulley 127. Supported by a pillow block (not shown) are idlers or reversing pulleys 140 and 141. Also supported by the pillow block and spaced from sheaves 127, 140, and 141 is a needle drive timing sheave 131 which supports a stroke cam 132 having an eccentric pinion 135. Contacting the sheaves as shown in FIG. 9 is a double sided, endless belt 145. This particular arrangement permits the present invention to drive stroke cam 132, without having to wrap belt 145 around the main drive shaft 120 or the main shaft timing sheave 127. This permits belt 145 to be replaced if it becomes broken and damaged, without the necessity of having to remove the main drive shaft 120. This arrangement, therefore, significantly reduces down time caused by this type of machine maintenance.

Figure 10:
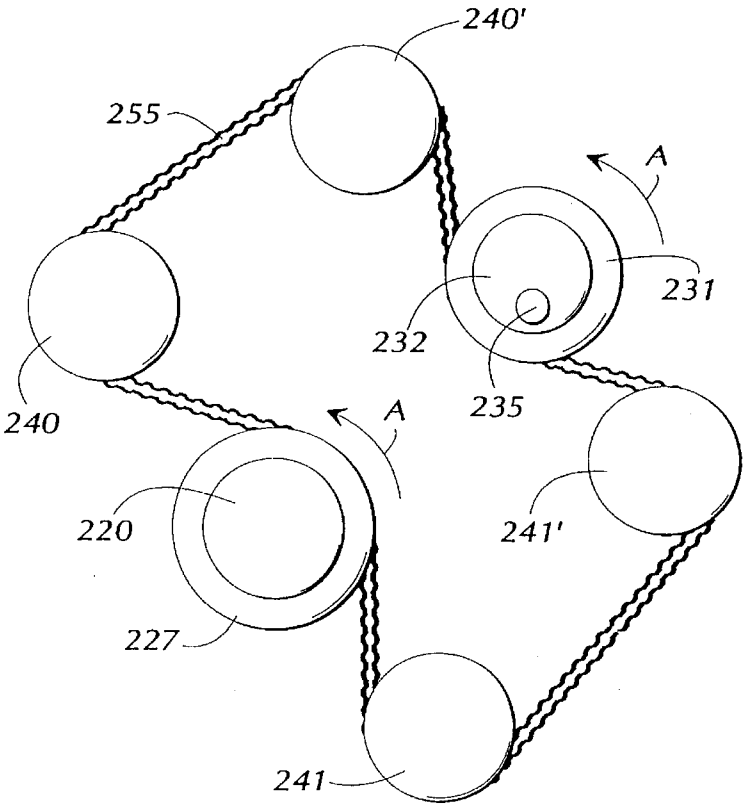
FIG. 10 is a schematic view of the sheave and belt arrangement of another embodiment of a positive needle bar drive assembly of the present invention.

FIG. 10 shows another belt and pulley arrangement of the present invention in which the belt is not wrapped around the main shaft. FIG. 10, however, illustrates an embodiment for a direct or positive needle stroke drive assembly. In FIG. 10, main drive shaft 220 supports main shaft timing sheave 227. In this embodiment, four idlers 240,240', 241, 241' are journaled by a pillow block (not shown) and spaced as shown in FIG. 10. A needle drive timing sheave 231 is also carried by the pillow block, and supports a stroke cam 232 having an eccentric pinion 235. A double sided drive belt 255 is wrapped around idlers 240, 240', 241 and 241' as shown in FIG. 10, but is not wrapped around either main shaft 220 or needle drive timing sheave 231. The rotation of the main drive shaft 220 in the direction of arrow A also causes the rotation of the needle drive timing sheave 231 and its associate stroke cam 232 in the direction of arrow A. The embodiment of FIG. 10 also accomplishes the benefit of not wrapping the timing belt around the main shaft 220 in order to reduce maintenance down time.

It is obvious to those skilled in the art that many modifications may be made to the preferred embodiment of the present invention, as set forth above, without departing substantially from the principles of the present invention. All such modifications are intended to be included herein within the scope of the present invention, as defined in the following claims.

Wherefore, the following is claimed:

1. A tufting machine of the type having a frame having a head, a main drive shaft supported for rotation about its axis within said frame, a plurality of transversely spaced, parallel, push rods carried by said head, said push rods protruding through said head and having their lower ends terminated outside of said head, and loopers disposed in said frame below said head for cooperating respectively with said needles for engaging and holding loops of yams sewn through a backing material passed between said needles and said loopers, wherein the improvement comprises:

(a) a plurality of spaced supports within said head;

(b) a plurality of spaced aligned stub shafts carried by said supports within said head, the axes of said stub shafts being parallel to said axis of said main drive shaft, said stub shales being respectively supported by said supports for rotation about their axes;

(c) drive sheaves respectively on said stub shafts;

(d) idle sheaves respectively adjacent certain of said sheaves;

(e) cranks connected to said stub shafts;

(f) spaced drive wheels on said main drive shaft;

(g) belts extending around said drive wheels and around certain of said drive sheaves, for rotating said certain of said drive sheaves in one direction;

(h) belts extending around other of said drive wheels and over a portion of said idler sheaves and around portions of the other of said drive sheaves on other of said stub shafts for rotating said other of said drive sheaves in a direction opposite to the direction of rotation of said certain of said drive sheaves;

(i) crank pins carried respectively by said cranks in offset relationship to their stub shaft axes for movement in opposite orbital paths when said stub shafts are rotated; and (j) connecting rods connected respectively by their upper portions to said crank pins and by their lower portions to the ends of said push rods for simultaneously actuating said push rods so that the upper portions of certain of said connecting rods are moved by their crank pins in first orbital paths in the same directions and the upper portions of other of said connecting rods are moved in second orbital paths in opposite directions to the first orbital paths.

2. The tufting machine defined in claim 1 and further comprising counterbalance weights respectively on said stub shafts for counterbalancing said connecting rods and said pins and said cranks.

3. The tufting machine defined in claim 2 wherein said weights counterbalance said loopers.

4. An assembly for reciprocating a plurality of members, comprising:

a main drive shaft having a longitudinal axis;

means for rotating said main drive shaft in a first direction;

first and second pulleys spaced apart from each other on said main drive shaft;

a first stub shaft having a third pulley, said first stub shaft being located parallel to said main drive shaft with said third pulley being spaced a predetermined distance from said first pulley;

a second stub shaft having a fourth pulley, said second stub shaft being located parallel to said main drive shaft with said fourth pulley being spaced said predetermined distance from said second pulley;

at least one idler spaced from said third pulley;

a first drive belt extending partially around said first pulley, partially around said at least one idler, and partially around a portion of said third pulley, said portion of said third pulley being located between said first stub and said main drive shaft;

a second drive belt extending partially around said second pulley and partially around a portion of said fourth pulley, said portion of said fourth pulley being located on a side of said second stub shaft opposite said main drive shaft;

first reciprocating means, attached to said first stub shaft, for reciprocating a first member upon rotation of said first stub shaft; and second reciprocating means, attached to said second stub shaft, for reciprocating a second member upon rotation of said second stub shaft;

wherein said first drive belt rotates said first stub shaft in a second direction, opposite said first direction, and said second drive belt rotates said second stub shaft in said first direction.

5. The assembly as set forth in claim 4, wherein the first and second members are each connected to one end of first and second push rods, respectively, with an opposite end of the push rods being connected to a needle bar.

6. An assembly for reciprocating a plurality of members, comprising:

a main drive shaft having a longitudinal axis;

means for rotating said main drive shaft in a first direction;

a first stub shaft located parallel to said main drive shaft and at a predetermined distance from said main drive shaft;

a second stub shaft located parallel to said main drive shaft and at said predetermined distance from said main drive shaft;

first drive means, connected between said main drive shaft and said first stub shaft, for rotating said first stub shaft in a second direction opposite said first direction;

second drive means, connected between said main drive shaft and said second stub shaft, for rotating said second stub shaft in said first direction;

first reciprocating means, attached to said first stub shaft, for reciprocating a first member upon rotation of said first stub shaft; and second reciprocating means, attached to said second stub shaft, for reciprocating a second member upon rotation of said second stub shaft.

7. The assembly as set forth in claim 6, wherein said first drive means comprises:

a first pulley on said main drive shaft;

a second pulley on said first stub shaft and aligned with said first pulley;

at least one idler; and a drive belt for extending partially around said first pulley, partially around said idler, and partially around said second pulley wherein said drive belt extends about a portion of said second pulley which is located on a side of said second pulley adjacent said main drive shaft.

8. The assembly as set forth in claim 6, wherein said second drive means comprises:

a first pulley on said main drive shaft;

a second pulley on said second stub shaft and aligned with said first pulley; and a drive belt for extending partially around said first pulley and partially around said second pulley wherein said drive belt extends about a portion of said second pulley which is located on a side of said second stub shaft opposite said main drive shaft.

9. The assembly as set forth in claim 6, further comprising a first counterweight on said first stub shaft and a second counterweight on said second stub shaft, said first and second counterweights generating forces having directions opposite to the directions of forces respectively generated by said first and second members.

10. The assembly as set forth in claim 6, further comprising a third stub shaft located parallel to said main drive shaft and at said predetermined distance from said main drive shaft;

third drive means, connected between said main drive shaft and said third stub shaft, for rotating said third stub shaft in said second direction; and third reciprocating means, attached to said third stub shaft, for reciprocating a third member upon rotation of said third stub shaft.

11. The assembly as set forth in claim 6, further comprising a third stub shaft located parallel to said main drive shaft and at said predetermined distance from said main drive shaft;

third drive means, connected between said main drive shaft and said third stub shaft, for rotating said third stub shaft in said first direction; and third reciprocating means, attached to said third stub shaft, for reciprocating a third member upon rotation of said third stub shaft.

12. The assembly as set forth in claim 6, wherein said first and second members are connected to one end of first and second push rods, respectively, an opposite end of said first and second push rods being connected to a needle bar.

13. An assembly for reciprocating a member upon rotation of a main shaft, comprising:

said main shaft having a first pulley;

means for rotating said main shaft in a first direction;

a pillow block having first and second upstanding flanges and a stub shaft extending through said first and second flanges, said stub shaft being parallel to said main shaft and having a second pulley which is aligned with said first pulley;

a drive belt wrapped partially around said first pulley and partially around said second pulley, said drive belt rotating said stub shaft upon rotation of said main shaft;

means, attached to said stub shaft, for reciprocating said member upon rotation of said stub shaft; and a counterweight attached to said stub shaft for being rotated with said stub shaft and for generating forces having directions opposite to the directions of forces generated by said member being reciprocated.

14. The assembly as set forth in claim 13, wherein said counterweight is positioned between said first and second upstanding flanges.

15. The assembly as set forth in claim 13, wherein said drive belt contacts a portion of said second pulley which is adjacent said main drive shaft.

16. The assembly as set forth in claim 13, further comprising at least one idler wherein said drive belt contacts a portion of said second pulley which is located opposite said main drive shaft.

17. The assembly as set forth in claim 16, wherein said second pulley and said one idler are mounted to a side surface of said first upstanding flange.

18. A process for balancing a tufting machine of the type having a needle bar, upstanding push rods coupled to the needle bar for reciprocating the needle bar upon axial movement of the push rods, connecting rods connected to respective push rods and extending upwardly from the push rods, the connecting rods having upper end portions that are coupled to spaced, aligned stub shafts for orbital movement of the connecting rod upper end portions upon rotation of the stub shafts, said process comprising the step of counterbalancing forces generated by movement of the needle bar, push rods, and connecting rods by disposing counterbalance weights on the respective stub shafts.

19. The process of claim 18 and wherein the step of counterbalancing forces generated by movement of the needle bar, push rods, and connecting rods by disposing counterbalance weights on the respective stub shafts further comprises positioning the counterbalance weights on the respective stub shafts for orbital movement of the counterbalance weights about 180 degrees out of phase with the orbital movement of their respective connecting rod upper end portions.

20. A process for balancing forces generated by the operation of a tufting machine of the type having a needle bar, an upstanding push rod attached to the needle bar for reciprocating the needle bar upon reciprocating movement of the push rod, a connecting rod connected to the push rod, the connecting rod extending upwardly from the push rod and having an upper end portion, the tufting machine also having an elongated, horizontally disposed drive shaft extending substantially the entire length of and parallel to the needle bar, and a stub shaft operatively connected to the drive shaft and driven by the drive shaft, the upper end portion of the connecting rod connected to the stub shaft for rotary movement of the connecting rod upper end portion upon rotation of the stub shaft, said process comprising the step of counterbalancing the forces generated by movement of the needle bar, push rod and connecting rod, by positioning a counterbalance weight on the stub shaft.

21. The process of claim 20 and wherein the step of counterbalancing forces generated by movement of the needle bar, push rod and connecting rod further comprises positioning the counterbalance weight on the stub shaft for rotary movement of the counterbalance weight about 180° out of phase with the rotary movement of the connecting rod upper end portion.

* * * * *